US008137255B2

(12) United States Patent
Meikrantz et al.

(10) Patent No.: US 8,137,255 B2
(45) Date of Patent: Mar. 20, 2012

(54) CENTRIFUGAL SEPARATOR DEVICES, SYSTEMS AND RELATED METHODS

(75) Inventors: David H. Meikrantz, Idaho Falls, ID (US); Jack D. Law, Pocatello, ID (US); Troy G. Garn, Idaho Falls, ID (US); Terry A. Todd, Aberdeen, ID (US); Lawrence L. Macaluso, Carson City, NV (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 614 days.

(21) Appl. No.: 12/337,988

(22) Filed: Dec. 18, 2008

(65) Prior Publication Data

US 2010/0160133 A1 Jun. 24, 2010

(51) Int. Cl.
*B04B 7/00* (2006.01)

(52) U.S. Cl. ..... 494/32; 494/37; 494/64; 210/236; 210/237

(58) Field of Classification Search ..... 494/22, 494/31, 32, 47, 48, 60, 62, 64, 37, 38, 43, 494/85; 210/232, 234, 235, 236, 237, 360.1, 210/380.1

See application file for complete search history.

(56) References Cited

U.S. PATENT DOCUMENTS

| | | | | |
|---|---|---|---|---|
| 3,845,788 | A | 11/1974 | Laven | |
| 4,925,441 | A * | 5/1990 | Jubin | 494/32 |
| 4,959,158 | A | 9/1990 | Meikrantz | |
| 5,286,379 | A * | 2/1994 | Jackson | 210/242.3 |
| 5,571,070 | A | 11/1996 | Meikrantz et al. | |
| 5,591,340 | A | 1/1997 | Meikrantz et al. | |
| 5,762,800 | A | 6/1998 | Meikrantz et al. | |
| 5,908,376 | A | 6/1999 | Macaluso et al. | |
| 6,363,611 | B1 | 4/2002 | Sheldon et al. | |
| 6,699,169 | B2 | 3/2004 | Ogino et al. | |
| 6,702,729 | B2 * | 3/2004 | Mazzuca | 494/26 |
| 6,986,734 | B2 | 1/2006 | Carr | |
| 7,150,836 | B2 | 12/2006 | Meikrantz | |
| 7,767,083 | B2 * | 8/2010 | Hoshino et al. | 210/232 |
| 7,794,383 | B2 * | 9/2010 | Tetsu et al. | 494/7 |
| 2010/0160133 | A1 * | 6/2010 | Meikrantz et al. | 494/10 |
| 2010/0160136 | A1 | 6/2010 | Meikrantz et al. | |
| 2010/0294709 | A1 | 11/2010 | Hoshino et al. | |

OTHER PUBLICATIONS

Meikrantz, David, et al., Continuous Liquid-Liquid Extraction Via an Improved Centrifugal Contactor, Cheresources.com, http://beta.cheresources.com/articles/continuous-liquid-liquid-extraction-via-an-improved-centrifugal-contactor.html, (1998).

Meikrantz, David, et al., Continuous Liquid-Liquid Extraction Via an Improved Centrifugal Contactor, Cheresources.com, http://beta.cheresources.com/articles/continuous-liquid-liquid-extraction-via-an-improved-centrifugal-contactor.html, undated.

United States Patent Application entitled Centrifugal Separators and Related Devices and Methods, U.S. Appl. No. 12/338,148, filed Dec. 18, 2008.

* cited by examiner

*Primary Examiner* — Charles E Cooley
(74) *Attorney, Agent, or Firm* — TraskBritt

(57) ABSTRACT

Centrifugal separator devices, systems and related methods are described. More particularly, fluid transfer connections for a centrifugal separator system having support assemblies with a movable member coupled to a connection tube and coupled to a fixed member, such that the movable member is constrained to movement along a fixed path relative to the fixed member are described. Also, centrifugal separator systems including such fluid transfer connections are described. Additionally, methods of installing, removing and/or replacing centrifugal separators from centrifugal separator systems are described.

21 Claims, 9 Drawing Sheets

CENTRIFUGAL SEPARATOR DEVICES, SYSTEMS AND RELATED METHODS

GOVERNMENT RIGHTS

This invention was made with government support under Contract Number DE-AC07-05ID14517 awarded by the United States Department of Energy. The government has certain rights in the invention.

CROSS-REFERENCE TO RELATED APPLICATION

This application is related to U.S. patent application Ser. No. 12/338,148, filed Dec. 18, 2008, entitled "CENTRIFUGAL SEPARATORS AND RELATED DEVICES AND METHODS," the disclosure of which application is incorporated herein in its entirety by reference.

TECHNICAL FIELD

The present invention relates to centrifugal separator devices, systems and related methods. More particularly, embodiments of the invention relate to fluid transfer connections for centrifugal separator systems having support assemblies with a movable member coupled to a connection tube and coupled to a fixed member, such that the movable member is constrained to movement along a fixed path relative to the fixed member. Embodiments of the invention also relate to centrifugal separator systems including such fluid transfer connections. Additionally, embodiments of the invention relate to installing, removing and/or replacing centrifugal separators from centrifugal separator systems.

BACKGROUND

Centrifugal separators use inertial forces resulting from the acceleration of a material, particularly the acceleration of a material in a circular path, for the separation of a heavier (more dense) material from a lighter (less dense) material. For example, such devices have been found to provide a relatively rapid method of separating immiscible liquids from one another based on different weight phases.

Centrifugal separators, such as centrifugal contactors, may be used for liquid-liquid separation, and particularly for solvent extraction processes. These centrifugal separators are termed "contactors" as fluid streams introduced separately into the device are brought together, or contacted, prior to a centrifugal separation of weight phases. For example, centrifugal contactors may be used to separate transuranic elements (TRUs) from radioactive waste streams at nuclear processing plants. In this process, a water-based nuclear waste stream (water phase) and organic solvent stream (organic solvent phase) may be fed into separate inlets of a centrifugal contactor and rapidly mixed in an annular space between a spinning rotor and a stationary housing of the centrifugal contactor. The TRUs may migrate from the water phase to the organic solvent phase as they are mixed in the annular space. The water phase and organic solvent phase are then centrifugally separated and exit through separate outlets of the centrifugal contactor, thus washing TRUs from the water-based waste with the organic solvent. However, due to limitations within the system, a centrifugal contactor may be less than 100% efficient. For example, less than 100% of the TRUs may be washed from the water phase by the organic solvent phase in a single centrifugal contactor. Accordingly, in some extraction applications several centrifugal contactors may be interconnected to allow multistage processes. By repeatedly mixing and separating the water phase and the organic phase, a multistage centrifugal contactor system may achieve relatively high levels of nuclear waste purification.

As may be expected, centrifugal contactor systems require regular maintenance. For example, a centrifugal contactor may need disassembly for cleaning and debris removal. Additionally, the electric motor, bearings, seals, and other components may need to be serviced, repaired and/or replaced. This servicing may require personnel to disassemble a centrifugal contactor in place, or remove the centrifugal contactor from the system, for repair or replacement. This may require personnel to spend several hours, or more, at the centrifugal contactor system site. However, some centrifugal contactor system sites may be dangerous to personnel and/or may be sensitive to potential contamination. For example, centrifugal contactor systems may potentially be used for processes such as the extraction of TRUs from radioactive waste streams, or for processing other toxic chemicals, exposure to which may be harmful to personnel. Additionally, centrifugal contactor systems may potentially be used in a cleanroom for the processing of pharmaceuticals, or other contaminant-sensitive chemicals.

In view of the above issues, it would be advantageous to provide improved centrifugal separators and related devices, systems and methods. For example, it would be advantageous to provide devices, systems and methods that enable the relatively rapid removal, installation and/or replacement of centrifugal separators. Additionally, it would be advantageous to provide devices, systems and methods that facilitate automated and/or remote removal, installation and/or replacement of centrifugal separators.

SUMMARY

In one embodiment, a fluid transfer connection for a centrifugal separator system comprises a connection tube and a support assembly. The connection tube includes a first connection fitting at a first end thereof and a second connection fitting at a second end thereof. The first and second connection fittings are sized and configured to sealingly couple to a corresponding first and second fluid port, wherein either, or both, of the first and second fluid ports is a fluid port of a centrifugal separator. The support assembly of the fluid transfer connection includes a fixed member and a movable member. The movable member is coupled to the connection tube and coupled to the fixed member, such that the movable member is constrained to movement along a fixed path relative to the fixed member, and the fixed member may be fixed relative to a centrifugal separator support frame.

In another embodiment, a centrifugal separator system comprises at least one centrifugal separator, a frame supporting each separator, and at least one fluid transfer connection. Each fluid transfer connection includes a connection tube and a support assembly. The connection tube includes a first connection fitting at a first end thereof and a second connection fitting at a second end thereof. The first and second connection fittings are sized and configured to sealingly couple to a corresponding first and second fluid port, wherein either, or both, of the first and second fluid ports is a fluid port of the at least one centrifugal separator. The support assembly of the fluid transfer connection includes a fixed member and a movable member. The movable member is coupled to the connection tube and coupled to the fixed member, such that the movable member is constrained to movement along a fixed path relative to the fixed member. The fixed member is fixed relative to a support frame of the at least one centrifugal separator.

In an additional embodiment, a method of installing a centrifugal separator includes positioning a centrifugal separator into a frame and operating an actuator to slide a fluid transfer connection and sealingly couple at least one connection fitting to at least one fluid port of the centrifugal separator.

DETAILED DESCRIPTION

Figure 1A:
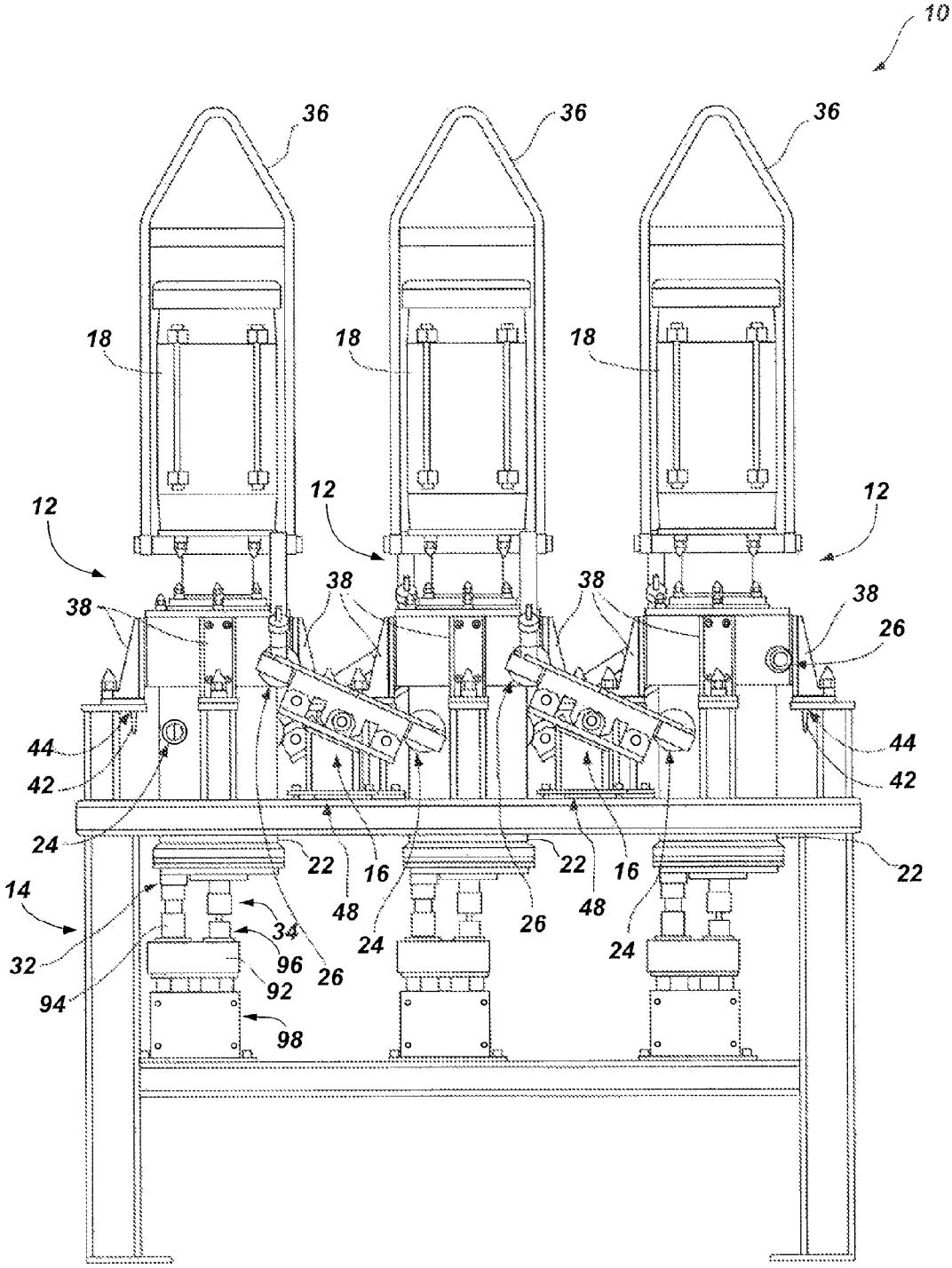
FIG. 1A shows a front view of a centrifugal separator system according to an embodiment of the present invention.
Figure 1B:
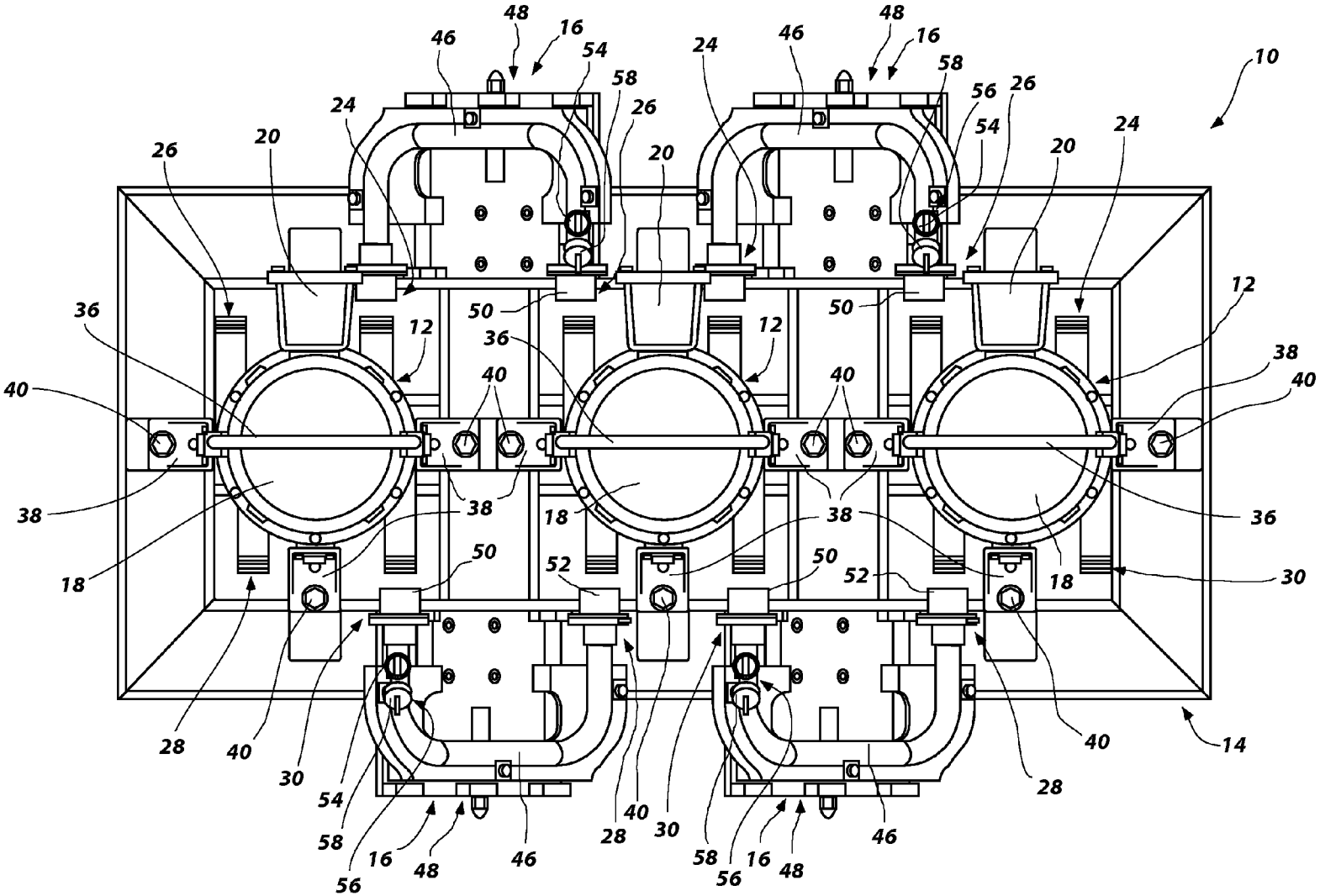
FIG. 1B shows a top view of the centrifugal separator system of FIG. 1A.
Figure 1C:
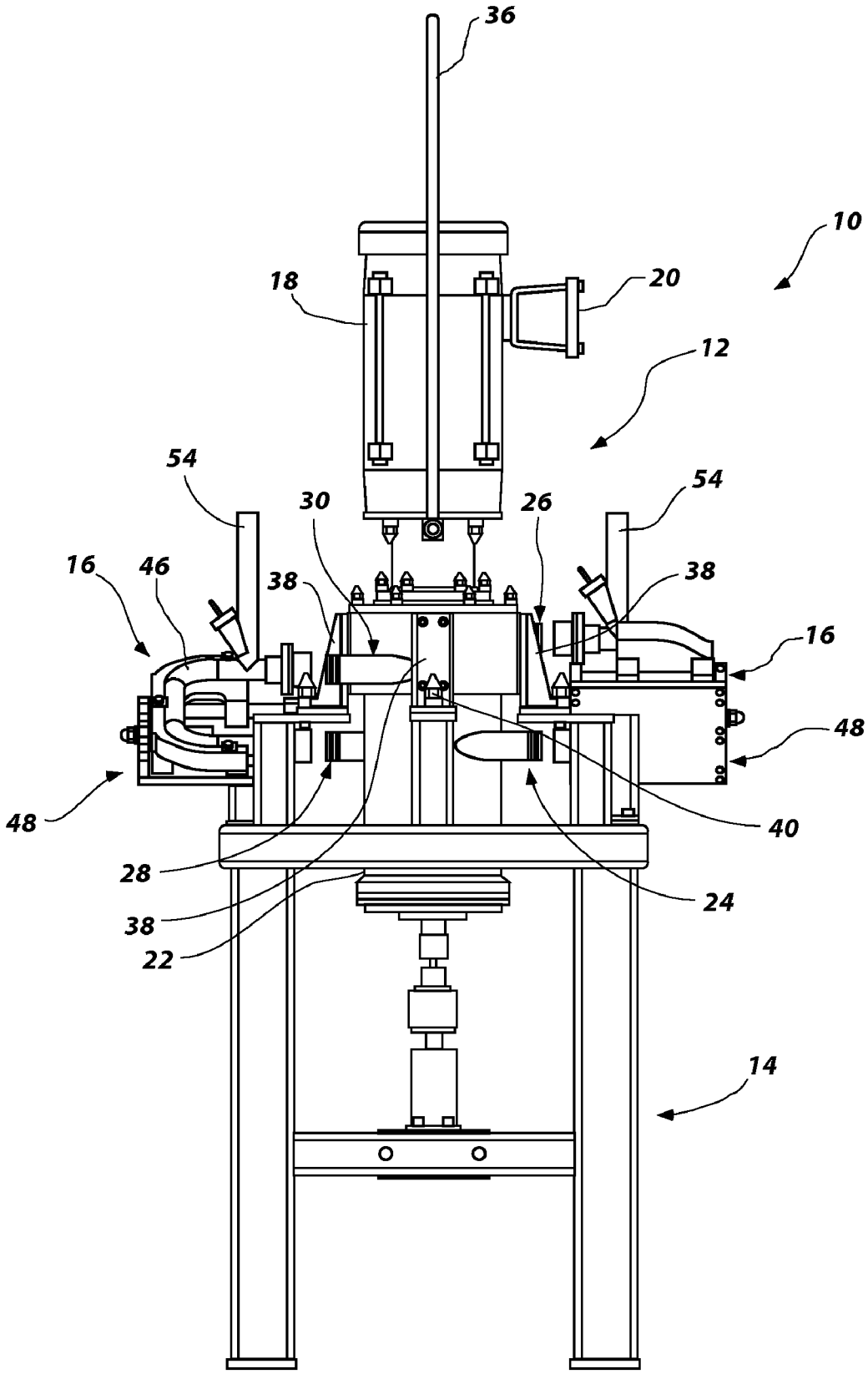
FIG. 1C shows a side view of the centrifugal separator system of FIG. 1A.

A centrifugal separator system, according to an embodiment of the present invention, is shown in FIGS. 1A-1C. The centrifugal separator system, which may be a centrifugal contactor system 10, includes at least one separator, such as centrifugal contactors 12, supported by a frame 14. The centrifugal contactor system 10 further includes fluid transfer connections 16 that may be arranged to interconnect the centrifugal contactors 12 or connect a centrifugal contactor 12 to another inlet or outlet source.

Each centrifugal contactor 12 of the centrifugal contactor system 10 may include a motor, such as electric motor 18, having a power connector 20 extending therefrom to a power source (not shown). Additionally, the electric motor 18 may include a shaft coupled to a rotor shaft 21 (shown in FIGS. 4A and 4B) within a stationary housing 22. A generally annular-shaped chamber may be located within the housing 22, surrounding the rotor shaft 21, and a plurality of fluid inlet and outlet ports 24-34 may be in fluid communication with the chamber. For example, a heavy or mixed phase inlet 24 and a heavy phase outlet 26 may be located at one side of each centrifugal contactor 12, and a light or mixed phase inlet 28 and a light phase outlet 30 may be located at another side. Optionally, each centrifugal contactor 12 may include a drain assembly 32 and a clean-in-place (CIP) fluid delivery fitting 34 located at the bottom thereof.

Examples of such centrifugal separators and systems including clean-in-place fluid delivery fittings and drain assemblies, and methods of cleaning such centrifugal separators, are disclosed in, for example, the aforementioned and incorporated U.S. patent application Ser. No. 12/338,148, filed Dec. 18, 2008, entitled "CENTRIFUGAL SEPARATORS AND RELATED DEVICES AND METHODS," of Meikrantz et al.

Each centrifugal contactor 12 may also include a lifting structure and a mounting structure. For example, each centrifugal contactor 12 may include a lifting bail 36 mounted to the electric motor 18 and a plurality of mounting brackets 38 mounted to the housing 22. The mounting brackets 38 may be configured to couple to the frame 14, for example the mounting brackets 38 may include holes to facilitate coupling the mounting brackets 38 to the frame 14 with mounting bolts 40. Some or all of the mounting brackets 38 may additionally include an alignment structure, such as a tapered guide pin 42 that may couple with a corresponding guide hole 44 in the frame 14.

The fluid transfer connections 16 for the centrifugal contactor system 10 each comprise at least one connection tube 46 and a support assembly 48. Each connection tube 46 includes a first connection fitting 50 at a first end thereof and a second connection fitting 52 at a second end thereof. As the working fluids may be relatively corrosive, the connection tubes 46 may be made from a corrosion resistant material, such as stainless steel.

Figure 3:
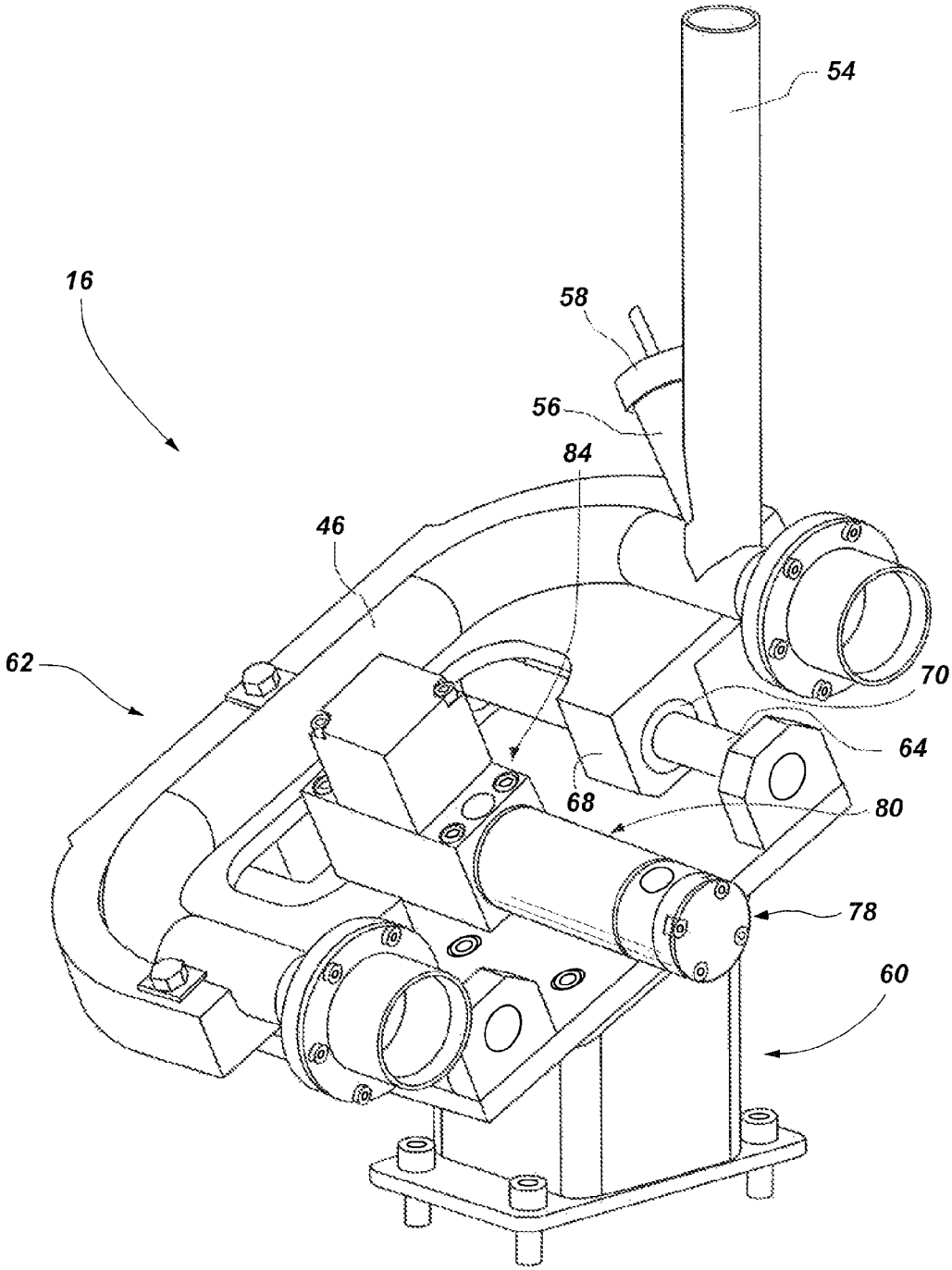
FIG. 3 shows an isometric view of another fluid transfer connection according to an additional embodiment of the present invention.

For each fluid transfer connection 16, the first connection fitting 50 is sized and configured to sealingly couple to a first fluid port and the second connection fitting 52 is sized and configured to sealingly couple to a second fluid port. For example, the first connection fitting 50 may be sealingly coupled to a heavy phase outlet 26 of a centrifugal contactor 12 and the second connection fitting 52 may be sealingly coupled to a heavy or mixed phase inlet 24 of another centrifugal contactor 12. Additionally, another connection tube 46 of the centrifugal contactor system 10 may have a first connection fitting 50 sealingly coupled to a light phase outlet 30 of a centrifugal contactor 12 and the second connection fitting 52 may be sealingly coupled to a light or mixed phase inlet 28 of another centrifugal contactor 12. Accordingly, each centrifugal contactor 12 of the centrifugal contactor system 10 may be interconnected with at least another centrifugal contactor 12 of the centrifugal contactor system 10 by a plurality of connection tubes 46. For example, each first and second connection fitting 50 and 52 may be configured with a connection sleeve having an inner surface (as shown in FIG. 3) sized and configured to slide over and seal against at least one elastic seal, such as in a manner similar as shown with reference to the fluid supply fitting 96 and elastic seals 126 of CIP fluid delivery fitting 34 shown in FIG. 4B. For example, the elastic seals may be elastomer O-rings.

Additionally, one or more connection tubes 46 may include a vent 54 and/or a sample port 56, which may include a cap 58. The vent 54 and sample port 56 may be located proximate the first connection fitting 50, such that the vent 54 and sample port 56 may be located proximate an outlet port 26 or 30 of the centrifugal contactor 12 when the first connection fitting 50 is coupled thereto.

The centrifugal contactor 12 may be operated under atmospheric pressure conditions. The working fluids entering the inlets 24 and 28 may be fed by gravity, and the working fluids may be moved through the centrifugal contactor 12 and out of the outlets 26 and 30 by the pumping effect of the spinning rotor shaft 21. In view of this process, the vent 54 may be located at or near the top of the connection tube 46 to allow vapor and gases to escape from the centrifugal contactor 12, and to allow the pressure within the centrifugal contactor 12 to remain consistent with the atmospheric pressure at the site, thus preventing pressure build-up and gas pockets from impeding fluid flow through the centrifugal contactor system 10.

The sample port 56 may be located proximate the vent 54, at or near the top of the connection tube 46. A sample extraction assembly (not shown) may include a needle that may be inserted through the cap 58. The tip of the needle may be inserted into the fluid within the connection tube 46 and fluid may be extracted from the connection tube 46 and deposited into a vial. The fluid sample in the vial may then be used for fluid analysis. The sample port 56 and sample extraction assembly may be configured such that the sample extraction assembly may be used to extract and retrieve fluid remotely. For example, a robotic arm may be used to extract and retrieve the fluid with the sample extraction assembly.

Figure 2:
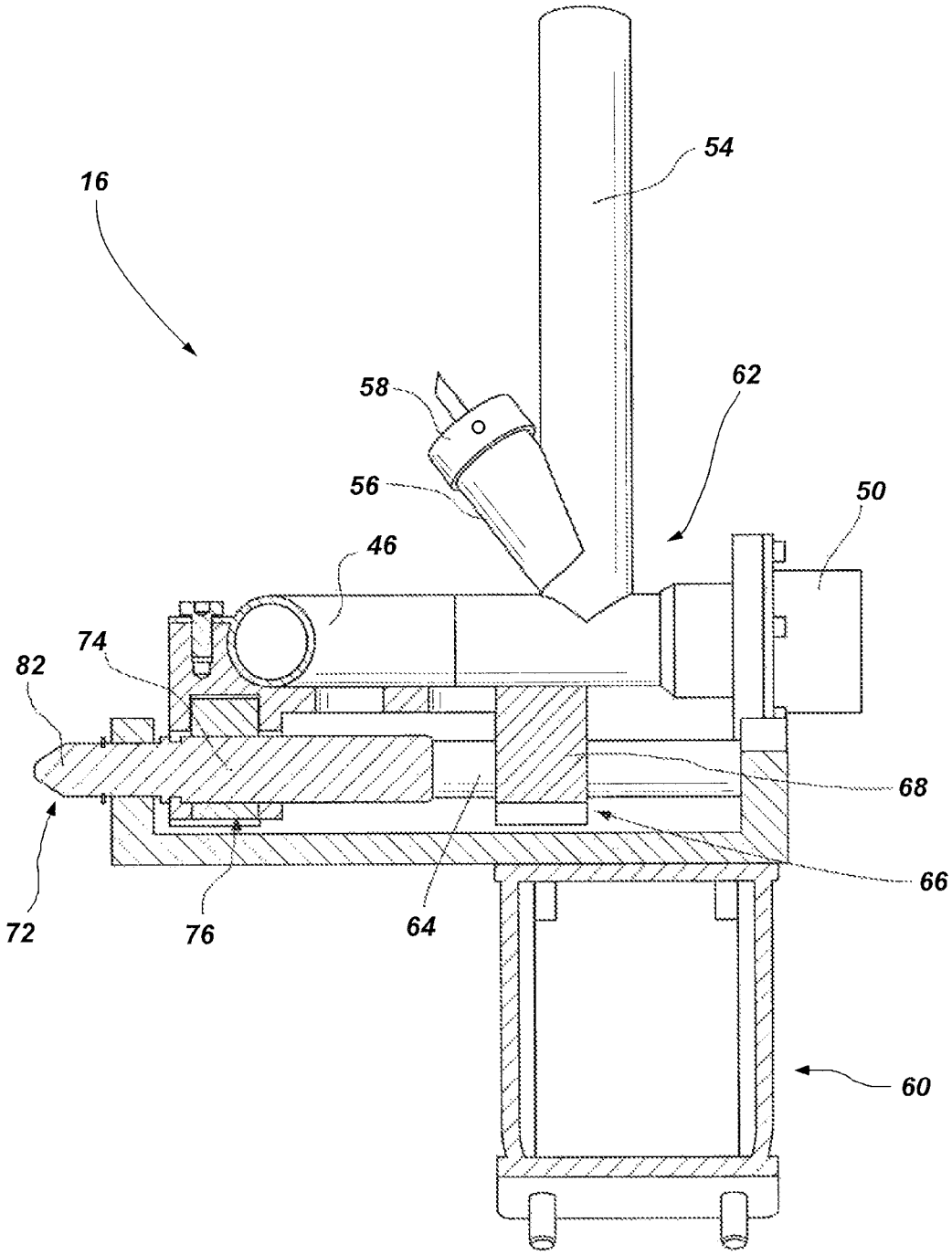
FIG. 2 shows a cross-sectional view of the fluid transfer connection shown in FIGS. 1A-1C.

The support assembly 48 of each fluid transfer connection 16 includes a fixed member 60 and a movable member 62 as shown in FIGS. 2 and 3, respectively. The fixed member 60 may be fixed relative the centrifugal contactor system 10 support frame 14, for example, the fixed member 60 may be mechanically fixed, fastened, and/or incorporated with the frame 14 (FIGS. 1A through 1C). The movable member 62 may be coupled to at least one connection tube 46 and coupled to the fixed member 60, such that the movable member 62 may be constrained to movement along a fixed path relative to the fixed member 60. For example, the fixed member 60 may include slide rails 64 slidably coupled to one or more guide members 66 of the movable member 62, which may mechanically limit the movement of the movable member 62 relative to the fixed member 60 to a linear path. In one embodiment, the guide members 66 may be cylindrical or tubular structures and the guide members 66 may comprise a bracket 68 with a cylindrical aperture holding an annular bushing 70 therein. The bushing 70 may be sized and configured such that the inner surface of the bushing 70 may slide along the outer surface of the mating guide member 66. In additional embodiments, the movable member 62 may be coupled to the fixed member 60 by a hinge or other mechanical linkage (not shown), such that the movable member 62 may move relative the fixed member 60 along a fixed arcuate path, or another fixed path configuration.

The support assembly 48 may further include an actuator, such as a linear actuator 72 including a rotatable screw 74 and a floating nut 76, as shown in FIG. 2, or a linear actuator 78 including a pressure actuated cylinder assembly 80, as shown in FIG. 3. In additional embodiments, an actuator may comprise at least one of a linear motor, an electric motor, a rack gear, a pinion gear, a worm drive, a chain, a spring, and a lever.

With reference to FIG. 2, the floating nut 76 of the linear actuator 72 may be fixed to the movable member 62 and the rotatable screw 74 may include a screw head 82 configured to mate with and be rotated by a tool. For example, the screw head 82 may be shaped as a standard hexagonal bolt head, as shown, or may be configured with a square bolt head, or a screw drive socket, such as a slotted (standard) socket, cross-head (Phillips) socket, a hex (Allen) socket, or any number of other configurations that will allow a tool to mate with and rotate a screw.

With regard to FIG. 3, the pressure actuated cylinder assembly 80 of the linear actuator 78 may have a cylinder body 84 fixed to the fixed member 60 (FIG. 2) of the support assembly 48 (FIGS. 1A-1C) and a piston rod fixed to the movable member 62. In additional embodiments, the cylinder body 84 may be fixed to the movable member 62 and the piston rod may be fixed to the fixed member 60.

Figure 4A:
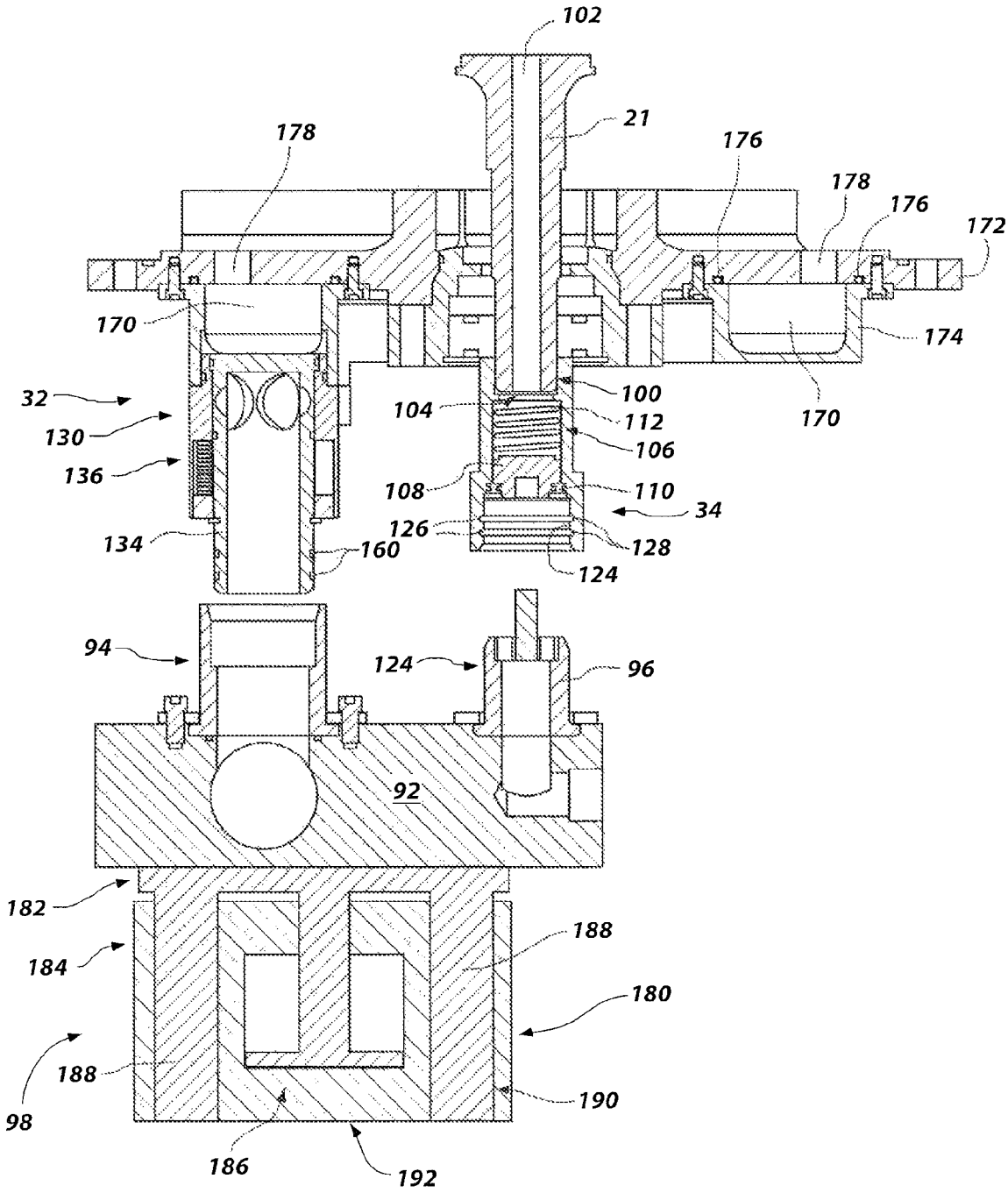
FIG. 4A shows a cross-sectional view of a manifold in a retracted position and a bottom portion of the centrifugal separator according to an embodiment of the present invention.
Figure 4B:
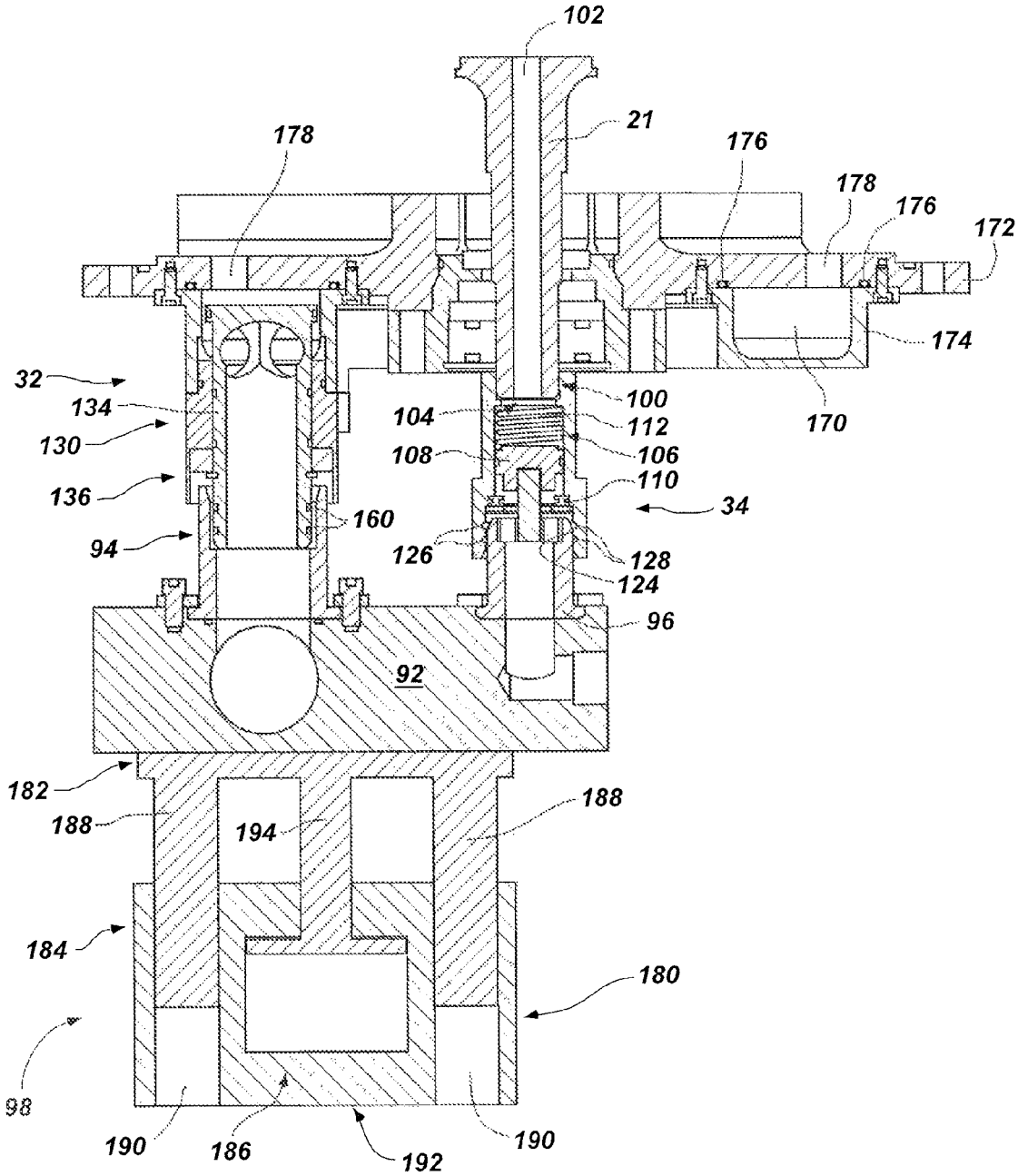
FIG. 4B shows a cross-sectional view of the manifold in a coupled position and the bottom portion of the centrifugal separator shown if FIG. 4A.

If the centrifugal contactors 12 include the optional drain assembly 32 and clean-in-place (CIP) fluid delivery fitting 34, the centrifugal contactor system 10 may include a corresponding manifold 92 (FIGS. 4A and 4B). The manifold 92 may be positioned below each centrifugal contactor 12 and may include a drain fitting 94, which corresponds to the drain assembly 32, and another fitting, such as a fluid supply fitting 96, which corresponds to the CIP fluid delivery fitting 34. The manifold 92 may be coupled to a support assembly 98 having a component fixed to the frame 14.

As shown in FIGS. 4A and 4B the CIP fluid delivery fitting 34 may be located proximate a tail end 100 of the rotor shaft 21 of the centrifugal contactor 12 and coupled directly to the tail end 100 of the rotor shaft 21. The rotor shaft 21 includes a longitudinal fluid passage 102 having an opening 104 at the tail end 100 of the rotor shaft 21 fluidly coupled to the CIP fluid delivery fitting 34. As such, the CIP fluid delivery fitting 34 is configured to deliver fluid into the longitudinal fluid passage 102 of the rotor shaft 21 through the opening 104 at the tail end 100 of the rotor shaft 21.

The CIP fluid delivery fitting 34 may additionally include a valve located proximate the tail end 100 of the rotor shaft 21. The valve may comprise a poppet valve 106, which may allow fluid flow in only one direction through the poppet valve 106, thus allowing fluid to flow through the CIP fluid delivery fitting 34 and enter the opening 104 at the tail end 100 of the rotor shaft 21 but not allow fluid flow exiting the opening 104 at the tail end 100 of the rotor shaft 21 to flow through the CIP fluid delivery fitting 34. For example, the poppet valve 106 may comprise a poppet 108, a seat 110 and a spring 112. The spring 112 may provide a biasing force to seal the poppet 108 against the seat 110 when the fluid supply fitting 96 is retracted from the CIP fluid delivery fitting 34, as shown in FIG. 4A. When the fluid supply fitting 96 is inserted into the CIP fluid delivery fitting 34 it may apply a force to the poppet 108 that may overcome the spring 112 force and unseat the poppet 108 and the fluid may flow through the seat 110 past the poppet 108, as shown in FIG. 4B.

The fluid supply fitting 96 may comprise a substantially smooth surface portion 124 that is configured to slidably couple and seal with one or more elastic seals 126 of the CIP fluid delivery fitting 34. As shown in FIG. 4B, upon coupling of the fluid supply fitting 96 and the CIP fluid delivery fitting 34, the smooth surface portion 124 of the fluid supply fitting 96 may compress a plurality of elastic seals 126, each seated in a seal gland 128 in the CIP fluid delivery fitting 34, and form a fluid tight seal between the fittings 34 and 96. For example, the plurality of elastic seals 126, and similarly other seals described herein, may be elastomeric O-rings, such as KALREZ® perfluoroelastomer O-rings available from DuPont Performance Elastomers L.L.C. of Wilmington, Del.

Figure 5:
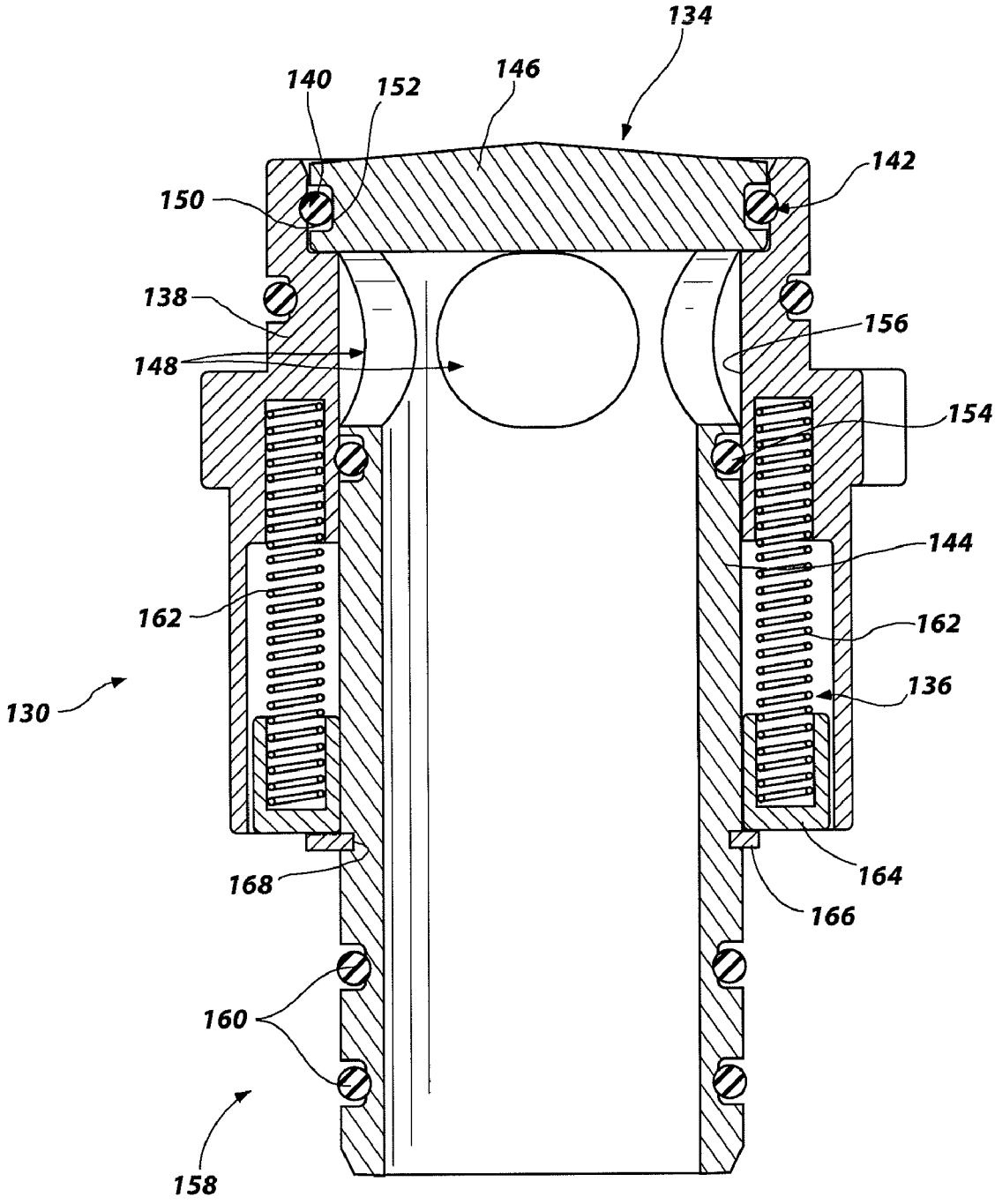
FIG. 5 shows a cross-sectional view of a drain valve assembly of the centrifugal separator shown in FIGS. 4A and 4B.

As shown in FIGS. 4A and 4B, the drain assembly 32 may comprise a drain valve assembly 130 located at the base of a fluid chamber of the centrifugal contactor 12 (FIGS. 1A-1C). As shown in a more detailed cross-sectional view in FIG. 5, the drain valve assembly 130 may comprise a movable poppet 134, a biasing mechanism 136 coupled to the poppet 134 and a valve body 138 having a seat 140 sized and configured to seal with a sealing portion 142 of the poppet 134 to prevent fluid flow past the seat 140.

The poppet 134 of the drain valve assembly 130 may comprise an annular body 144, a poppet head 146 coupled to the annular body 144 and a plurality of apertures 148 located in the annular body 144 proximate the poppet head 146. The poppet head 146 may be configured generally as a disc comprising the sealing portion 142 at the periphery thereof. The sealing portion 142 may include an elastic seal 150, such as an elastomer O-ring, positioned in a seal gland 152, which may be compressed against the seat 140 of the valve body 138 to form a fluid tight seal between the poppet head 146 and the seat 140. Additionally, an elastic seal 154 may be positioned below the apertures 148 in the annular body 144 and form a fluid tight seal between the annular body 144 and a substantially smooth wall 156 of the valve body 138, such that fluid may not leak into the biasing mechanism 136 or outside of the drain valve assembly 130. The annular body 144 of the poppet 134 may extend out of the valve body 138 and include a sealing portion 158 comprising one or more elastic seals 160, such as elastomer O-rings, such that the annular body 144 of the poppet 134 may be sized and configured to slidably couple and seal with the drain fitting 94, as shown in FIG. 4B.

The biasing mechanism 136 of the drain valve assembly 130 may comprise one or more helical springs 162 located between a portion of the valve body 138 and the poppet 134. The springs 162 may have one end positioned against a surface of the valve body 138 and another end positioned against a surface of a structure 164 coupled to the annular body 144 of the poppet 134. For example, the structure 164 may be an annular structure encircling the annular body 144 of the poppet 134 and positioned against a retaining ring 166 that is located in a groove 168 formed in the surface of the annular body 144 of the poppet 134. The biasing mechanism 136 may be configured to apply a biasing force against the poppet 134, which may cause the poppet head 146 of the poppet 134 to seal against the seat 140 of the valve body 138 and prevent fluid flow therethrough.

As shown in cross-sectional view in FIGS. 4A and 4B, the drain assembly 32 may be located at the base of a solids collection chamber 170, formed between the bottom plate 172 of the centrifugal contactor 12 (FIGS. 1A though 1C) and a solids collector ring 174. The solids collector ring 174 may be sealed to the bottom plate 172 of the centrifugal contactor 12 with one or more seals 176 and positioned below a plurality of apertures 178 within the bottom plate 172. The apertures 178 in the bottom plate 172 may be sized and configured to allow the passage of solids from the separation chamber into the solids collection chamber 170, defined by the bottom plate 172 and the solids collector ring 174.

Referring again to FIGS. 4A and 4B, the manifold 92, which includes the drain fitting 94 and the fluid supply fitting 96, may be coupled to a support assembly 98 that includes a fixed member 180 and a movable member 182. The fixed member 180 may be fixed to the frame 14 and coupled to the movable member 182, which is coupled to the manifold 92, through a guide structure 184 and/or an actuator 186.

The guide structure 184 may be configured to constrain the movement of the movable member 182 to a fixed path, such as a linear path, relative the fixed member 180. For example, the guide structure 184 may comprise one or more guide rods 188 having one end coupled to the movable member 182. Each guide rod 188 may be positioned at least partially within a guide sleeve 190, such that the guide sleeves 190 may constrain the movement of the guide rods 188 and the movable member 182 to a fixed linear path.

The actuator 186 may be configured to move the movable member 182, and thus the manifold 92, the fluid supply fitting 96, and the drain fitting 94, along the fixed path relative the fixed member 180. For example, the actuator 186 may be a linear actuator, such as a pressure actuated cylinder assembly (as shown) or a mechanical actuator having a rotatable screw (not shown).

The actuator 186 may comprise a cylinder body 192 fixed to the frame 14 (FIGS. 1A through 1C) and a piston rod 194 fixed to the movable member 182. In additional embodiments, the cylinder body 192 may be fixed to the movable member 182 and the piston rod 194 may be fixed to the frame 14.

In an additional embodiment, the actuator 186 may be a mechanical actuator (similar to the linear actuator 72 shown in FIG. 2) comprising a rotatable screw mated with a floating nut. The floating nut may be fixed to the movable member 182 and the rotatable screw may be coupled to the frame 14. The floating nut may be coupled to the rotatable screw, such that the floating nut may translate along the rotatable screw as the screw is rotated.

The centrifugal contactor system 10, as described herein, may facilitate the installation, removal and replacement of centrifugal contactors 12. For example, if a centrifugal contactor 12 requires repair, routine maintenance, or replacement, the centrifugal contactor 12 may be relatively rapidly removed from the centrifugal contactor system 10, the centrifugal contactor 12 may then be repaired, serviced or replaced by another centrifugal contactor 12 and relatively rapidly installed back into the centrifugal contactor system 10. Additionally, the centrifugal contactor system 10 may facilitate automated and/or remote removal and/or installation of a centrifugal contactor 12.

To begin the removal process, valves may be used to stop the flow of fluid into the fluid inlets 24, 28 of the centrifugal contactor system 10. Then, one or more of the centrifugal contactors 12 may be drained. Optionally, a clean-in-place process may also be performed to remove remaining working fluids or debris from each centrifugal contactor 12.

When a centrifugal contactor is installed or removed or, optionally, during a centrifugal separation process, the manifold 92 may be in a retracted position. When the manifold 92 is in a retracted position, the fluid supply fitting 96 may be separated and out of contact with the CIP fluid delivery fitting 34 and the drain fitting 94 may be separated and out of contact with the drain assembly 32, as shown in FIG. 4A. The drain valve assembly 130 may be in a closed position, such that the poppet 134 is sealed against the seat 140 of the valve body 138 and fluid may be prevented from flowing through the drain valve assembly 130. Also, the poppet valve 106 of the CIP fluid delivery fitting 34 may be in a closed position, such that fluid may be prevented from flowing through the poppet valve 106.

During normal operation of the centrifugal contactor system 10 the fluid transfer connections 16 are in a coupled position, wherein each first and second connection fitting 50 and 52 may be fluidly coupled to a fluid port. For the removal of a centrifugal contactor 12, each fluid transfer connection 16 having a first connection fitting 50 and/or a second connection fitting 52 coupled to a fluid port of the centrifugal contactor 12 to be removed may be moved from the coupled position to a retracted position. This movement to a retracted position may be accomplished by actuating an actuator, such as a linear actuator 72 and/or 78. For example, with reference to FIG. 2, the screw head 82 of the screw 74 may be rotated by a tool and cause the screw 74 to rotate. The rotating screw 74 may cause the floating nut 76 to move along the rotating screw 74 toward the screw head 82 of the screw 74. This will cause the movable member 62 to slide along the slide rails 64 away from the centrifugal contactor 12 to a retracted position, and one or more of the first and second connection fittings 50 and 52 may be decoupled from one or more fluid fittings 24, 26, 28 and 30 of the centrifugal contactor 12. In another embodiment, with reference to FIG. 3, the movable member 62 may be caused to slide along the slide rails 64 to a retracted position by supplying a pressurized fluid, such as air or hydraulic fluid, to the pressure actuated cylinder assembly 80.

The supplied pressurized fluid may cause the piston rod to extend from the cylinder body 84 and thus push the movable member 62 along the slide rails 64 away from the centrifugal contactor 12 to the retracted position.

The power connection 20 of each centrifugal contactor 12 to be removed may be decoupled from its associated power source. If an electric motor 18 is used, as shown, the power connection 20 may include metal prongs that slidably mate with an electric power supply socket. The electric power supply socket may be sized and configured such that a robotic arm may couple and decouple the electric power supply socket from the power connection 20. If a hydraulic or pneumatic motor is used, the power connection may include fluid connection fittings that may slidably mate with fluid supply and return fittings.

If fasteners, such as mounting bolts 40, are used to couple the mounting brackets 38 to the frame 14, the fasteners may be removed. For example, a fastener removal device, such as a robotic arm including a rotatable socket, may be operated to remove the fasteners.

Figure 6:
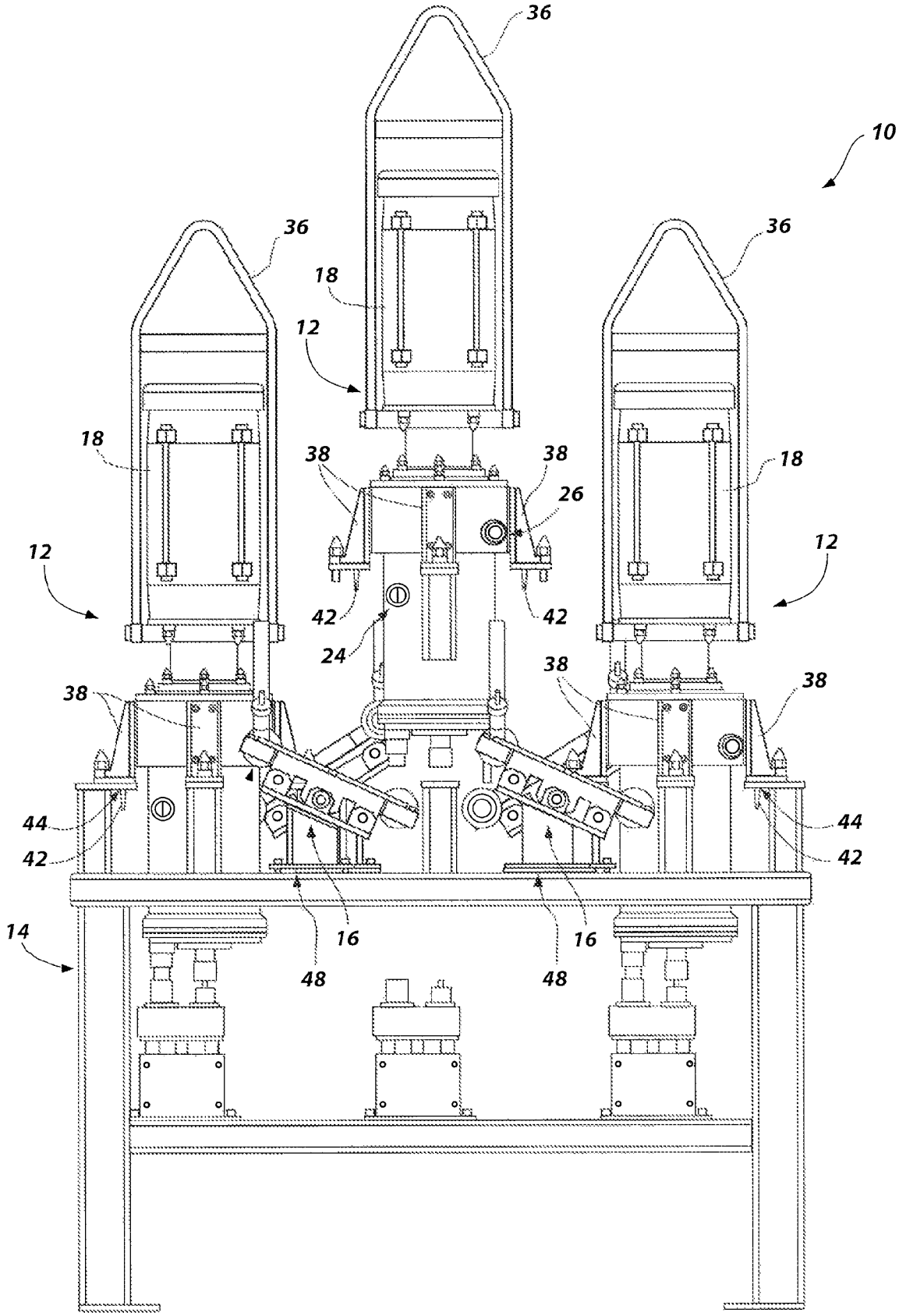
FIG. 6 shows a front view of a centrifugal separator lifted from the centrifugal separator system of FIGS. 1A-1C.

A lifting device may then be coupled to the lifting structure of the centrifugal contactor 12 to be removed. For example, a hook attached to an overhead crane may be coupled to the lifting bail 36. The crane may lift the centrifugal contactor 12 from the frame 14. As the centrifugal contactor 12 is lifted from the frame 14, the guide pins 42 will be retracted from the guide holes 44, which may facilitate the lifting of the centrifugal contactor 12 in a fixed linear path as it is decoupled from the frame 14, as shown in FIG. 6.

After the centrifugal contactor 12 has been removed from the centrifugal contactor system 10, the centrifugal contactor 12 may be transported away from the centrifugal contactor system 10 site for servicing, repair, cleaning, disposal and/or some other purpose.

Conversely, a centrifugal contactor 12 may be installed into the centrifugal contactor system 10. The centrifugal contactor 12 may be transported to the centrifugal contactor system 10 site and a lifting device, such as an overhead crane, may be coupled to the lifting structure, such as the lifting bail 36, of the centrifugal contactor 12. The overhead crane may lift the centrifugal contactor 12 and position the centrifugal contactor 12 above the frame 14. The centrifugal contactor 12 may be rotated and/or otherwise aligned with the frame 14, such that the centrifugal contactor 12 may be lowered in a substantially linear path into the frame 14. As the centrifugal contactor 12 approaches its final position within the frame 14 guide pins 42 may mate with corresponding guide holes 44. The guide pins 42 may be tapered, such that if the alignment of the centrifugal contactor 12 to the frame 14 is not perfect the guide pins 42 may still mate with the guide holes 44. As the centrifugal contactor 12 is further lowered into the frame 14 the guide pins 42 and guide holes 44 may cause the centrifugal contactor 12 to be properly positioned relative to the frame 14.

Fasteners, such as mounting bolts 40, may be installed, such as by a robotic arm including a rotatable socket, to couple the mounting brackets 38 to the frame 14. The power source may be coupled to the centrifugal contactor 12 after the mounting brackets 38 are coupled with the frame 14. For example, the power source may be coupled to the power connection 20 by operating a robotic arm.

The fluid transfer connection 16 may then be moved from the retracted position to the coupled position by operating at least one actuator, such as linear actuator 72 and/or 78, to couple the first and second connection fittings 50 and 52 of the connection tubes 46 and the fluid ports 24, 26, 28 and 30 of the centrifugal contactor 12. Working fluids may then be reintroduced into the centrifugal contactor 12, the electric motor 18 may cause the rotor shaft 21 to rotate and the centrifugal contactor 12 may be returned to regular fluid separation service.

After a centrifugal contactor 12 is installed, particularly during a clean-in-place procedure, the actuator 186 may be operated to move the movable member 182 from a retracted position (as shown in FIG. 4A) to a coupled position (as shown in FIG. 4B). The movement of the movable member 182 by the actuator 186 may cause the fluid supply fitting 96 to be moved into contact and coupled with the CIP fluid delivery fitting 34 and the drain fitting 94 to be substantially simultaneously moved into contact and coupled with the drain assembly 32.

Such devices, systems and methods as described herein may facilitate the relatively rapid installation, removal and/or replacement of centrifugal contactors. Additionally, such devices, systems and methods may facilitate automated or remote installation, removal and/or replacement of centrifugal contactors. For example, a controller that includes a microprocessor and a memory device may be programmed to control equipment, such as the crane, robotic arm, and various actuators 72 and 78 described herein to automatically install, remove and/or replace centrifugal contactors 12 of the centrifugal contactor system 10. In another example, remotely located controls may be used with one or more cameras and/or observation windows to control equipment, such as the crane, robotic arm, and various actuators 72 and 78 described herein, and allow one or more operators to install, remove and/or replace centrifugal contactors 12 of the centrifugal contactor system 10 from a remote location.

In light of the above disclosure it will be appreciated that the devices, systems and methods depicted and described herein may enable the effective installation, removal and/or replacement of centrifugal contactors used for processes such as the extraction of transuranic elements from radioactive waste streams, or for processing toxic chemicals. Also, devices, systems and methods depicted and described herein may enable the effective installation, removal and/or replacement of centrifugal contactors used in a cleanroom for the processing of pharmaceuticals, or other contaminant sensitive chemicals. In addition, it is contemplated that the invention may have additional utility in a variety of other fluid handling applications.

While specific embodiments of the invention have been shown by way of example in the drawings and have been described in detail herein, the invention is not limited to the particular forms disclosed. Rather, the invention includes all modifications, equivalents, and alternatives falling within the scope of the invention as defined by the following appended claims and their legal equivalents.

What is claimed is:

1. A centrifugal separator system comprising:

at least one centrifugal separator having a plurality of fluid ports;

a frame supporting the at least one centrifugal separator;

at least one fluid transfer connection comprising:

a connection tube comprising:

a first connection fitting at a first end thereof, the first connection fitting sized and configured to sealingly couple to a first fluid port; and a second connection fitting at a second end thereof, the second connection fitting sized and configured to sealingly couple to a second fluid port, and wherein at least one of the first and second fluid ports is a fluid port of the plurality of fluid ports of the at least one centrifugal separator; and a support assembly comprising:

a fixed member, fixed relative to the frame; and a movable member coupled to the connection tube and coupled to the fixed member in a manner constraining movement of the movable member and the connection tube along a fixed path relative to the fixed member.

2. The centrifugal separator system of claim 1, further comprising:

at least one tapered guide pin coupled to at least one mounting bracket of the at least one centrifugal separator; and at least one guide hole located on the frame, the at least one guide hole sized and configured to mate with the at least one guide pin.

3. The centrifugal separator system of claim 1, further comprising a drain fitting coupled to a support assembly having a component fixed relative the frame, the drain fitting sized, located and configured to slidably couple to a drain assembly of the at least one centrifugal separator.

4. The centrifugal separator system of claim 3, wherein the drain assembly of the at least one centrifugal separator comprises a poppet valve.

5. The centrifugal separator system of claim 4, further comprising a cleaning fluid fitting coupled to the support assembly, the cleaning fluid fitting sized, located and configured to slidably couple to a cleaning fluid delivery structure located proximate a tail end of a rotor shaft of the at least one centrifugal separator.

6. The centrifugal separator system of claim 5, wherein the cleaning fluid delivery structure comprises a valve.

7. The centrifugal separator system of claim 1, further comprising a lifting bail coupled to the at least one centrifugal separator.

8. The centrifugal separator system of claim 1, wherein each centrifugal separator of the at least one centrifugal separator comprises a centrifugal contactor and the frame comprises a centrifugal contactor support frame.

9. The centrifugal separator system of claim 1, wherein the at least one fluid transfer connection further comprises an actuator positioned and configured to move the movable member along the fixed path.

10. The centrifugal separator system of claim 9, wherein the fixed path is a fixed linear path and wherein the actuator is a linear actuator.

11. The centrifugal separator system of claim 1, wherein each of the first and second connection fittings comprises a connection sleeve having an inner surface sized and configured to slide over and seal against at least one elastic seal.

12. The centrifugal separator system of claim 1, wherein the connection tube further comprises a sample port.

13. The centrifugal separator system of claim 12, wherein the connection tube further comprises a vent.

14. A method of installing a centrifugal separator system, wherein the centrifugal separator system comprises:

at least one centrifugal separator having a plurality of fluid ports;

a frame supporting the at least one centrifugal separator; and at least one fluid transfer connection comprising:

a connection tube comprising:

a first connection fitting at a first end thereof, the first connection fitting sized and configured to sealingly couple to a first fluid port; and a second connection fitting at a second end thereof, the second connection fitting sized and configured to sealingly couple to a second fluid port, and wherein at least one of the first and second fluid ports is a fluid port of the plurality of fluid ports of the at least one centrifugal separator; and a support assembly comprising:

a fixed member, fixed relative to the frame; and a movable member coupled to the connection tube and coupled to the fixed member in a manner constraining movement of the movable member and the connection tube along a fixed path relative to the fixed member;

the method comprising:

positioning the at least one centrifugal separator onto the frame; and operating an actuator to move the at least one fluid transfer connection along the fixed path to sealingly couple at least one of the first and second connection fittings to at least one of the first and second fluid ports of the at least one centrifugal separator.

15. The method of claim 14, wherein positioning the centrifugal separator onto the frame further comprises mating at least one guide pin with at least one guide hole.

16. The method of claim 14, wherein operating an actuator to move the at least one fluid transfer connection along the fixed path comprises operating a linear actuator to move the at least one fluid transfer connection along a linear fixed path.

17. The method of claim 16, wherein operating a linear actuator comprises providing at least one of a pressurized liquid and a pressurized gas to a pressure actuated cylinder assembly.

18. The method of claim 16, wherein operating a linear actuator comprises rotating a screw within a floating nut.

19. The method of claim 14, further comprising operating the actuator from a remote location.

20. The method of claim 14, further comprising operating another actuator to move a drain fitting along a fixed path to form a fluid tight coupling between the drain fitting and a drain assembly of the centrifugal separator while substantially simultaneously opening a valve in the drain assembly by applying a force to a valve component with the drain fitting.

21. The method of claim 20, further comprising operating the another actuator to move a cleaning fluid fitting along a fixed path to form a fluid tight coupling between the cleaning fluid fitting to a cleaning fluid delivery structure of the centrifugal separator.

* * * * *